United States Patent [19]

Ryd et al.

[11] 4,108,382

[45] Aug. 22, 1978

[54] SPRAYING DEVICE

[75] Inventors: Per-Olof Ryd; Sten Gunnar Hugo Svensson, both of Skara, Sweden

[73] Assignee: Atlas Copco Aktiebolag, Nacka, Sweden

[21] Appl. No.: 751,212

[22] Filed: Dec. 16, 1976

[30] Foreign Application Priority Data

Dec. 18, 1975 [SE] Sweden ..... 7514316
Dec. 19, 1975 [SE] Sweden ..... 7514486

[51] Int. Cl.[2] ..... B05C 5/02
[52] U.S. Cl. ..... 239/271; 239/70; 134/167 R; 141/311 R; 118/317; 427/236
[58] Field of Search ..... 134/166 R, 167 R, 168 R, 134/24; 141/311, 386; 118/317; 427/236; 239/67, 69, 70, 271

[56] References Cited

U.S. PATENT DOCUMENTS

| | | | |
|---|---|---|---|
| 1,682,544 | 8/1928 | Young et al. | 141/311 X |
| 3,227,575 | 1/1966 | Ziebart | 427/236 |
| 3,559,891 | 2/1971 | Hedberg et al. | 239/443 |
| 3,945,533 | 3/1976 | Otto | 239/70 X |

*Primary Examiner*—Robert W. Saifer
*Attorney, Agent, or Firm*—Flynn & Frishauf

[57] ABSTRACT

A spraying device for applying, through an injection opening, a coating material such as anticorrosion oil onto the inner walls of a hollow body, comprising a spray gun provided with an atomizing nozzle and an interchangeable front piece connected down stream thereof. The front piece comprises an ejector barrel for introduction through said injection opening and a positioning collar rigidly attached thereto, the positioning collar. The latter being adapted to define the position of the ejector barrel during spraying. A control unit connected to the spray gun comprises means for determining the duration of each spray operation from the very moment the trigger of the spray gun is pulled.

9 Claims, 4 Drawing Figures

SPRAYING DEVICE

This invention relates to a spraying device for spray coating of internal surfaces of hollow objects and more particularly to a spraying device for applying a surface layer on the walls of a closed cavity having one or more injection openings.

An application for such a device is anticorrosion treatment of car bodies which contain a plurality of cavities of different size and form.

When such treatment is carried out at an assembly line where the time of treatment has to be kept down, it is of great importance that the time interval disposable for spraying is used to its optimum. Today the problem concerning spraying of cavities in car bodies is that the distribution of the spray material is completely up to the operator's ability. Without time loss and without being able to look inside the cavity he has to apply the spraying device in a correct manner so that the spray material reaches all parts of the cavity.

It is also a problem to obtain a proper surface layer in a cavity as far as the amount of supplied spray material is concerned. Apart from the question of obtaining an optimal location and direction of the spraying device the result of the operation may be spoiled if too small an amount of material is supplied. As the operator cannot see the treated surfaces and as he has a very limited time to spend on each spraying position it is not unlikely that he will discontinue the spraying too early, which means that the amount of spray material that is necessary for obtaining a desired surface coating is not supplied.

On the contrary, if he extends the time of spraying too long it will cause an undesirable high spray material consumption and also in some cases an impaired working environment as a result of for instance oil spillage on the floor.

The object of the present invention is to provide a spraying device by means of which it is possible to obtain an accurate spraying position and spraying direction for a certain cavity to be sprayed and to also supply a properly adapted amount of spray material. With the invention, spraying of a certain cavity can be performed very rapidly, and at the same time an effective and properly distributed surface layer will be obtained. It is possible to thus obtain an optimum use of time and spray material.

DETAILED DESCRIPTION

Figure 4:
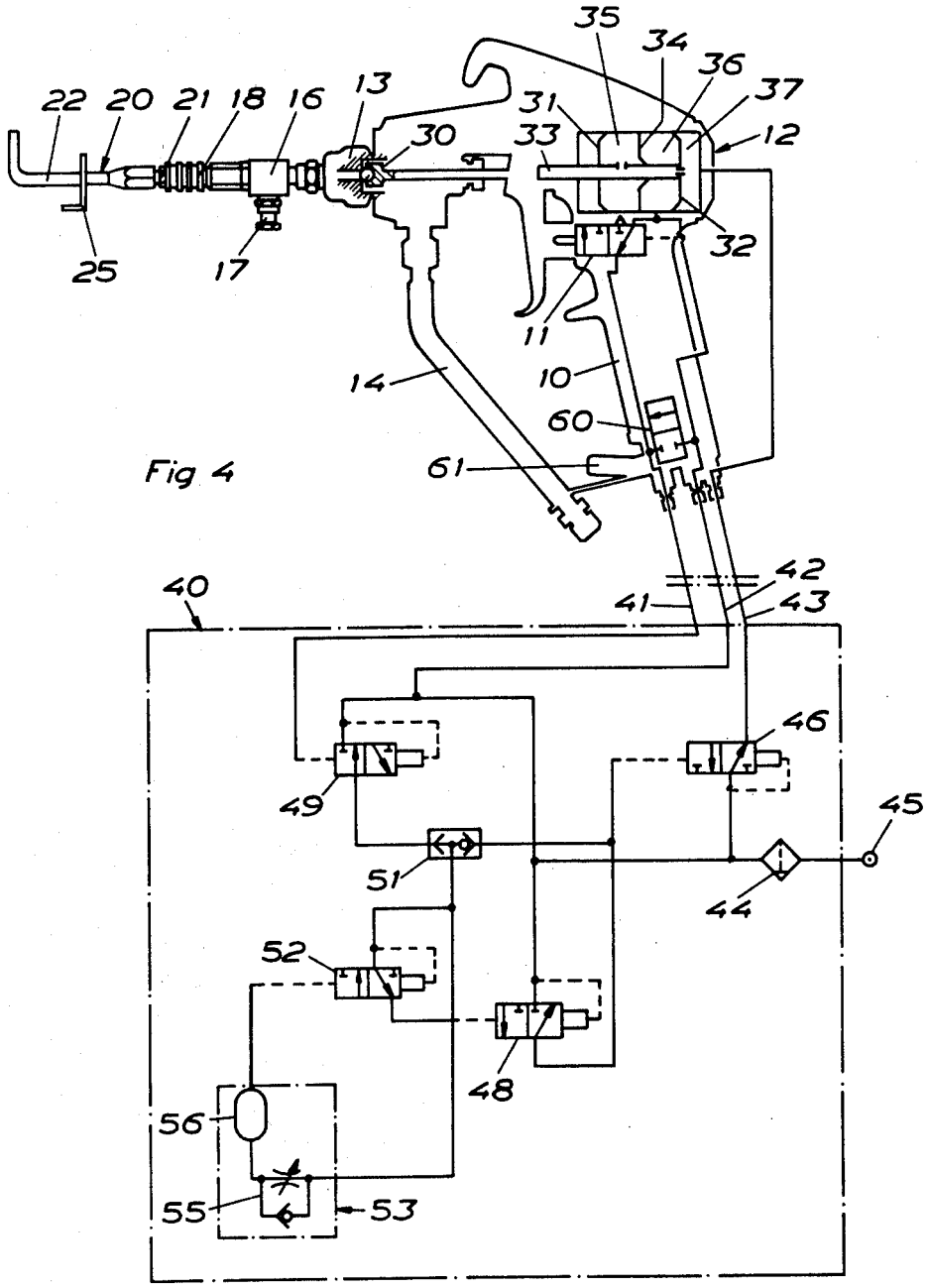
FIG. 4 shows schematically the spray gun in FIGS. 1 and 2 connected to a control unit.

The spray gun shown on the drawings comprises a handle 10, a trigger valve 11 and a pneumatic servomotor 12 which is controlled by the valve 11 for operating a spray material valve 30 (FIG. 4). The trigger valve 11 and the servo-motor 12 are supplied with pressure air through connections on the handle 10. At its forward end the gun is provided with an atomizing nozzle 13 which is supplied with spray material under pressure through a conduit 14 and the spray material valve 30.

The design and operation of the servo-motor 12 is described in U.S. Pat. No. 3,559,891 and a brief description only will be presented below in connection with the control unit.

Downstream of the atomizing nozzle 13 the gun is coupled to a connection block 16 which is provided with an inlet nipple 17 for connection of a pressure air conduit. At its downstream end the connection block 16 is provided with a quick coupling means 18. A front piece 20 is connectible to the connection block 16 by means of a quick coupling means 21 mating with that of the connection block 16. Pressure air may be supplied through nipple 17 in order to support the transportation of atomized spray material out through the front piece 20.

Figure 1:
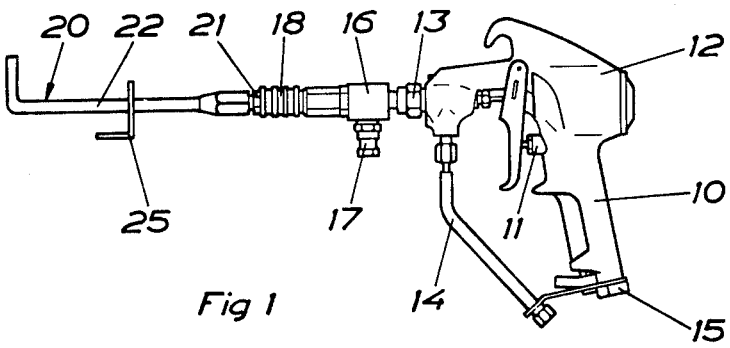
FIG. 1 shows a side elevation of a spray gun which constitutes a part of the spraying device according to the invention.
Figure 2:
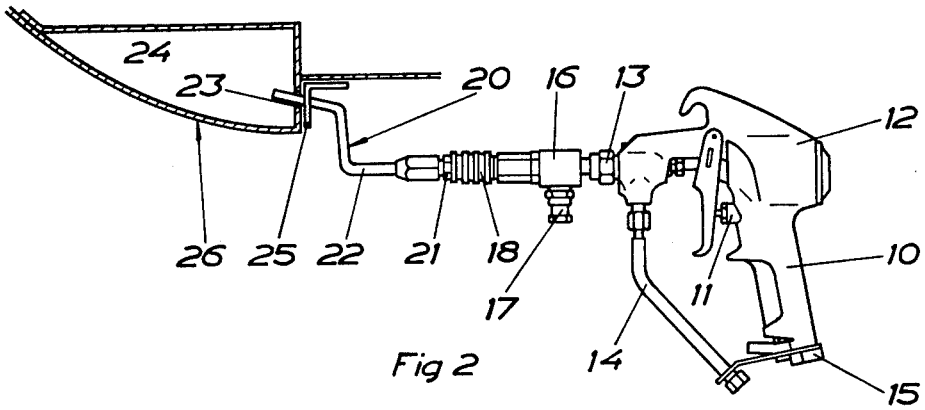
FIG. 2 shows the spray gun in FIG. 1 in connection with an object being sprayed.
Figure 3:
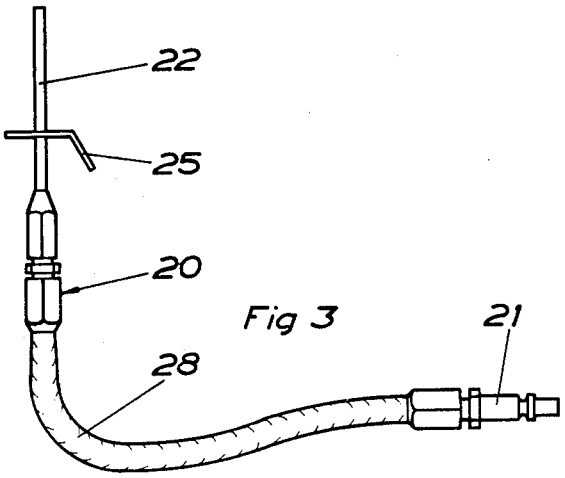
FIG. 3 shows a flexible type front piece.

The front piece 20 comprises an ejector barrel 22 which is designed so as to obtain a desired spray position when introduced into a cavity through an injection opening 23. See FIG. 2. As the cavity 24 has a certain shape and as the injection opening 23 has a certain location relative to the cavity it is essential that the ejector barrel 22 be brought into a correct position for obtaining a proper covering of the cavity walls. However, a correct design of the ejector barrel itself is not enough to exactly define the desired spraying position and direction. The ejector barrel 22 has to be fixed relative to the cavity as regards direction, angular position and depth of intrusion. This is obtained by a positioning collar 25 which is rigidly attached to the ejector barrel 22. The positioning collar 25 is designed so as to put the ejector barrel 22 into the desired spraying position by engagement with the outer surface of the body in which the cavity is located.

In order to obtain a correct distribution of the coating material in the cavity it is necessary that the ejector barrel 22 as well as the positioning collar 25 be individually designed and adapted to each of the injection points. The character of an injection point is defined by the shape of the cavity and the very location of the injection opening in relationship thereto. A good covering of a cavity is obtained simply by introducing the ejector barrel through an injection opening and ensuring that the positioning collar is put into alignment with the outside surface of the body forming the cavity. Most cavities, however, have to be treated in two different injection points because those parts of the cavity walls that are located close to one injection opening can only be properly covered from another injection opening.

The spraying device according to the invention is by its front piece 20 specially adapted to a predetermined injection point at a certain cavity. This means that this device very well may be used at a great number of similar spraying objects for instance car bodies. During car manufacturing where a great number of different cavities on each car body shall be coated it is possible either to use a number of spraying devices each provided with one front piece adapted to a certain injection point or a few spray guns in which the front pieces have to be changed for adapting them to a number of injection points.

At some injection points it may be difficult to obtain a proper alignment between the positioning collar 25 and the outer surface of the body if the front piece 20 is rigid. In order to facilitate the application of the spraying device at such injection points the front piece may be provided with a flexible hose part 28 between the positioning collar 25 and the quick coupling means 21.

The servo-motor 12 of the spray gun comprises two pistons 31, 32 attached to a common piston rod 33. A cylindrical bore in the spray gun housing and a stationary intermediate wall 34 define together with the pistons 31, 32 three separate cylinder chambers 35, 36, 37 of which chambers 35 and 37 communicate with each other through a passage in the piston rod 33.

When all three of the chambers 35 – 37 of the servo-motor 12 are pressurized the spray material valve 30 is kept closed, and as the chambers 35 and 37 are depressurized the valve 30 is open.

A control unit 40 is connected to the spray gun via the conduits 41, 42 and 43. The last mentioned conduit communicates directly with the chambers 35 and 37 of the servo-motor 12. The conduit 42 communicates with the chamber 36 as well as with the trigger valve 11. The conduit 41 communicates with the trigger valve 11 only.

The control unit 40 which is connected to the pressure air source 45 via a filter 44 comprises a control valve 46 which via the conduit 43 controls the pressure air supply to chambers 35 and 37 of the servo-motor 12. The control valve 46 has the operation order NOT which means that it is open in its rest position. In its rest position valve 46 maintains communication between the chambers 35 and 37 and the pressure air source 45.

The control unit 40 is arranged to establish direct contact between the pressure air source 45 and the chamber 36 of the servo-motor 12 via the conduit 42.

A valve 48 having the operation order YES is arranged to connect the left hand side of the control valve 46 to the pressure air source 45, thereby accomplishing closing of the control valve 46.

The left hand side of a sensing valve 49 of the operation order NOT is connected to the trigger valve 11 of the spray gun via the conduit 41. The left hand side of the sensing valve 49 is pressurized towards its closed position as long as trigger valve 11 is not activated. When the trigger valve 11 is activated the left hand side of the sensing valve 49 is depressurized and valve 49 is shifted from its closed to its open position. The inlet of the sensing valve 49 is directly connected to the pressure air source 45. When activated, sensing valve 49 accomplishes opening of the valve 48.

Between the valves 48 and 49 there is connected an alternating valve 51, which is described below, and a valve 52 of the operation order NOT.

Between valve 52 and the alternating valve 51 there is a timing means 53 comprising a variable restriction valve 55 and a volume 56.

The operation of the described spraying device is as follows. As the control unit 40 is connected to the pressure air source 45 pressure air will reach cylinder chamber 36 of the servo-motor 12 via the conduit 42. Thereby, the chamber 36 is pressurized. At the same time pressure air reaches the control valve 46 which is pressurized towards its left position as shown in FIG. 4. In this position valve 46 lets pressure air through to the conduit 43 and cylinder chambers 35 and 37 of the servo-motor 12. The pressure load on the right motor piston 32 is equal in both directions so the pressure load acting upon the left piston 31 in the chamber 35 will be determining for obtaining a closing force upon the spray material valve 30.

At the same time pressure air reaches trigger valve 11 which in its inactive position (see FIG. 4) allows air to be conducted to the left hand side of the sensing valve 49 via the conduit 41. The right hand side as well as the inlet of valve 49 are directly connected to the pressure air source, but due to the fact that the cross section of the right hand side of the valve is less than the cross section of the left hand side the valve is maintained in its closed right hand side position.

The pressure air source also communicates with the right hand side of the valve 48 which has the operation order YES. Because of the fact that the left hand side of valve 48 is not pressurized the valve is maintained in its left, closed position.

As trigger valve 11 is activated the pressure supply to the left hand side of the sensing valve 49 is discontinued, which means that this valve is shifted to its left hand, open position. Now pressure air may pass on to the alternating valve 51 which in turn allows air to pass to the inlet as well as to the right hand side of the valve 52. The latter is thereby biased toward its left open position. Pressure air may now enter the left hand side of the valve 48, and since the left hand side of the valve has a larger cross section than the right hand side the valve 48 is shifted to its right, open position.

The result of this is that pressure air reaches the left hand side of the control valve 46. Due to the difference in cross section between the right and the left hand sides of the valve 46 the latter is shifted to its right hand position. In this position valve 46 connects the chambers 35 and 37 of the servo-motor 12 to the atmosphere. The constant pressure in the chamber 36 actuates piston 32, piston rod 33 and the spray material valve 30 to the right. As the spraying device via the conduit 14 is continuously connected to pressure source for spray material, opening of the spray material valve 30 means starting of a spraying operation.

As pressure air is passed through the sensing valve 49 and alternating valve 51, air is supplied to the timing means 53. Thereby, pressure air passes the restriction valve 55 and enters the volume 56. Since volume 56 is closed the pressure therein will increase successively until full pressure is reached. By full pressure is meant the pressure of the pressure air source. As full pressure is reached the pressure load upon the left hand side of the valve 52 will be dominating and valve 52 is shifted to its closed position.

Now the left hand side of the valve 48 is depressurized and valve 48 is shifted to the left, thereby venting the left hand side of the control valve 46. The control valve 46 is shifted to its left hand position and air communication is reestablished between the chambers 35 and 37 of the servo-motor 12 and the pressure air source 45. The servo-motor 12 activates the spray material valve 30 to its closed position and the spraying operation is interrupted.

The duration of the spraying operation is determined by the time interval which is needed to build up the pressure in volume 56 through the restriction valve 55. A desired time interval for the spraying operation may be set by adjusting the cross section of the restriction valve 55.

The shown and described spraying device is fully automatic and ensures a determined length of time for the spraying operation and thereby a desired amount of spray material each time the trigger valve 11 is activated, no matter for how long this activation is continued. If for instance the trigger valve 11 is activated for a too short time interval the result would be that the sensing valve 49 shuts off the air supplied to the alternating valve 51, the valve 52 and the timing means 53. Owing to the fact that pressure air has forced the valve 48 to its open position already the alternating valve 51 will change position so that instead the valve 52 and the timing means 53 are supplied with pressure air from a point downstream of the valve 48. The result is that the spraying operation is continued until full pressure is obtained in the volume 56 in the way described above. In case the trigger valve 11 is activated for too long a time interval the spraying operation is still discontinued as soon as the pressure in the volume 56 is strong enough to close the valve 52 and thereby discontinue pressurizing of the left hand side of the valve 48. The valve 48 is closed and the pressure continuously acting on the right hand side of the control valve 46 will move the latter to its open position.

Moreover, the described spraying device is provided with a safety valve 60 by which the conduits 41 and 42 may be interconnected. This is obtained by turning the knob 61. The safety valve 60 is intended to ensure an uninterrupted pressurizing of the left hand side of the sensing valve 49 which means that the spray gun is not activatable. A corresponding type of valve for a manually operated spray gun is described in detail in the above mentioned U.S. Pat. No. 3,559,891.

The embodiments of the invention are not limited to the shown and described example but can be freely varied within the scope of the invention as it is defined in the claims.

What we claim is:

1. Spraying device for applying a coating material on the inner walls of a hollow body through an injection opening in the latter, comprising:

a spray gun having a coating material valve, an ejector barrel connected downstream of the coating material valve for conducting coating material into the hollow body through the injection opening, and a positioning means inluding means for engaging the outside of the hollow body for fixing said ejector body at a predetermined direction relative to the hollow body, at a predetermined depth of intrusion in the hollow body and at a predetermined angular position in said hollow body, and for substantially preventing relative movement between said ejector barrel and said hollow body during spraying.

2. Spraying device according to claim 1, wherein said ejector barrel as well as the positioning means are adapted to a hollow body of a certain shape and to a certain injection opening location on the hollow body.

3. Spraying device according to claim 2, wherein said positioning means comprises a collar which is rigidly attached to said ejector barrel.

4. Spraying device according to claim 1, wherein said coating material valve comprises a spray material valve, and the spraying device further comprises a servomotor for actuating said spray material valve, a manually operable trigger means for activating the servomotor, and a control unit connected to said servomotor and to said trigger means for activating said servomotor for a predetermined time interval upon activation of said trigger means.

5. Spraying device according to claim 4, wherein the servomotor is a pneumatic piston motor the piston means of which is continuously biased by a first pressure air load in the opening direction of the spray material valve, and which at closed spray material valve is biased by a second, oppositely acting pressure air load as well, said second pressure air load exceeding sid first load, and wherein said control unit comprises a control valve for controlling that pressure air supply to said servomotor from which said second pressure air load depends, and a timing means arranged to activate said control valve to closed position during a predetermined time interval, thereby discontinuing said second pressure air load and opening said spray material valve during said time interval 6. Spraying device according to claim 1, wherein the spray gun comprises an atomizing nozle located between the coating material valve and said ejector barrel.

7. Spraying device according to claim 6, comprising a connection block coupled between the atomizing nozzle and said ejector barrel, said connection block and said ejector barrel being provided with mating quick coupling means.

8. Spraying device for applying, at injection points, a coating material on the inner walls of cavities in a body, comprising:

a spray gun provided with an atomizing nozzle, and a quick coupling means connected downstream thereof, and a set of a plurality of different interchangeable front pieces each of which is provided with a quick coupling means mating with the quick coupling means of the spray gun, each of said front pieces including ejector means and positioning means, said positioning means including means for engaging said body for fixedly and substantially immovably locating said ejector means of the respective front pieces at a different predetermined orientation relative to said body at a respective one of said injection points for establishing an optimal spray position in accordance with the shape of the actual cavity and the location of the respective injection point.

9. Spraying device according to claim 8, wherein said ejector means of each of said front pieces comprises an ejector barrel, and said positioning means of each of said front pieces comprises a position defining collar rigidly attached to the respective front piece, said collar including means for supporting said ejector barrel in a desired spray position by engaging the outer surface of said body.

* * * * *